US005360182A

United States Patent [19]

Badiou

[11] Patent Number: 5,360,182

[45] Date of Patent: Nov. 1, 1994

[54] EXPANDABLE CYLINDRICAL CHUCK FOR COILER OR UNCOILER

[75] Inventor: Jean-Claude Badiou, Veauche, France

[73] Assignee: Clecim, Cergy-Pontoise, France

[21] Appl. No.: 4,237

[22] Filed: Jan. 14, 1993

[30] Foreign Application Priority Data

Jan. 14, 1992 [FR] France ..... 92 00311

[51] Int. Cl.[5] ..... B65H 75/24

[52] U.S. Cl. ..... 242/573.7

[58] Field of Search ..... 242/72.1, 72 R, 72 B, 242/68.2, 78.3; 279/2.1, 2.11, 2.12, 2.13, 2.14, 2.15, 2.16, 2.18; 269/48.1, 48.2, 48.3, 48.4

[56] References Cited

U.S. PATENT DOCUMENTS

| | | | |
|---|---|---|---|
| 2,280,970 | 4/1942 | O'Neil et al. | 242/72.1 |
| 2,941,745 | 6/1960 | Sterling et al. | 242/72.1 |
| 5,123,606 | 6/1992 | Braun et al. | 242/72.1 |

FOREIGN PATENT DOCUMENTS

| | | | |
|---|---|---|---|
| 1491416 | 7/1967 | France . | |
| 1160814 | 1/1964 | Germany | 242/72.1 |
| 2610511 | 9/1976 | Germany . | |
| 873891 | 8/1961 | United Kingdom . | |

*Primary Examiner*—John M. Jillions
*Attorney, Agent, or Firm*—Pollock, Vande Sande & Priddy

[57] ABSTRACT

An expandable cylindrical chuck for a coiler, with at least one restricted position and one expanded position. The chuck has a longitudinal axis (1) and comprises a chuck body (3) with a nose (5) and a rear section (7) a tubular sheath (9), segments (11) movable crosswise with respect to the longitudinal axis (1), a control shaft (15) controlling the longitudinal displacement of the segments (11), closing bars (17) located parallel to the longitudinal axis (1) between and in contact with the segments, a pinching bar (23) and a driving shaft (2). The nose (5) and the rear section (7) of the chuck body (3) each comprise an annular surface (39, 41) ensuring tight contact between the chuck body (3) and the segments (11) and between the closing bars (17) and the pinching bar (23).

9 Claims, 4 Drawing Sheets

EXPANDABLE CYLINDRICAL CHUCK FOR COILER OR UNCOILER

FIELD OF THE INVENTION

The invention relates to an expandable cylindrical chuck for a coiler or winder and uncoiler or unwinder.

In sheet or strip production units by a rolling process, the rolled product is coiled or uncoiled on a winding or unwinding machine located at the output or input section of the cage or at the end of a rolling, processing or shearing line.

More generally, coilers or winders and uncoilers or unwinders are used in the manufacture of flat, strap-like products, such as sheets, strips, cardboard boxes, papers and the like.

DESCRIPTION OF THE PRIOR ART

A coiler or uncoiler comprises an expandable chuck centered on a longitudinal axis and associated by a driving shaft with a control apparatus of the chuck rotating around its longitudinal axis.

The coiler chuck must be expanded when receiving the head of the strip and retracted at the end of the coiling, when the reel is completed, to allow separation from the chuck.

The uncoiler chuck must be restricted when receiving the reel and expanded in order to uncoil the reel.

The chucks normally comprise a chuck body inside which are located rack-mounted means for longitudinal displacement. Segments which are laterally displaceable with respect to the chuck body lean directly or indirectly against the tilted surfaces of the rack. Thus the position of the rack with respect to the chuck body determines the clearance of the segments and consequently the diameter of the chuck.

The segments, when apart from one another, leave spaces through which various contaminants are liable to penetrate inside the chuck and to affect its operation. This is especially disturbing with small iron particles from the strap reels which may penetrate between the friction segments of the chucks, thereby reducing their durability, and necessitating frequent lubricating and dismounting operations.

SUMMARY OF THE INVENTION

It is an object of the invention is to eliminate these shortcomings in order to improve the durability of the chucks.

Another object of the invention is to provide an expandable cylindrical chuck which may be lubricated throughout its lifetime.

A further object of the invention is to provide a chuck which may function without having to be dismantled.

Another object of the invention to provide a tight, expandable cylindrical chuck.

To this end, the invention relates to an expandable cylindrical chuck for a coiler or uncoiler, with at least one restricted and an expanded position, and with a longitudinal axis.

The chuck comprises a chuck body with a nose and a rear section, and containing a tubular sheath, segments, rack-mounted means for longitudinal displacement to move the segments crosswise with respect to the longitudinal axis, a control shaft for longitudinal displacement of the segments, closing bars located parallel to the longitudinal axis between the segments and in contact with them, a pinching bar and a driving shaft.

According to the invention, the nose and the rear section of the chuck each comprise an annular surface ensuring tight contact between the chuck body and the segments, and between the closing bars and the pinching bar.

Seals are preferably located between the annular surfaces of the chuck body and the segments, the closing bars and the pinching bar.

Preferably, the closing bars carry seals ensuring contact with the segments.

According to a preferred embodiment, seals are provided between the pinching bar and the segments located on both sides thereof.

BRIEF DESCRIPTION OF THE DRAWINGS

A preferred embodiment of the invention will be described in detail, with reference to the attached drawings, in which.

DESCRIPTION OF A PREFERRED EMBODIMENT

Figure 1:
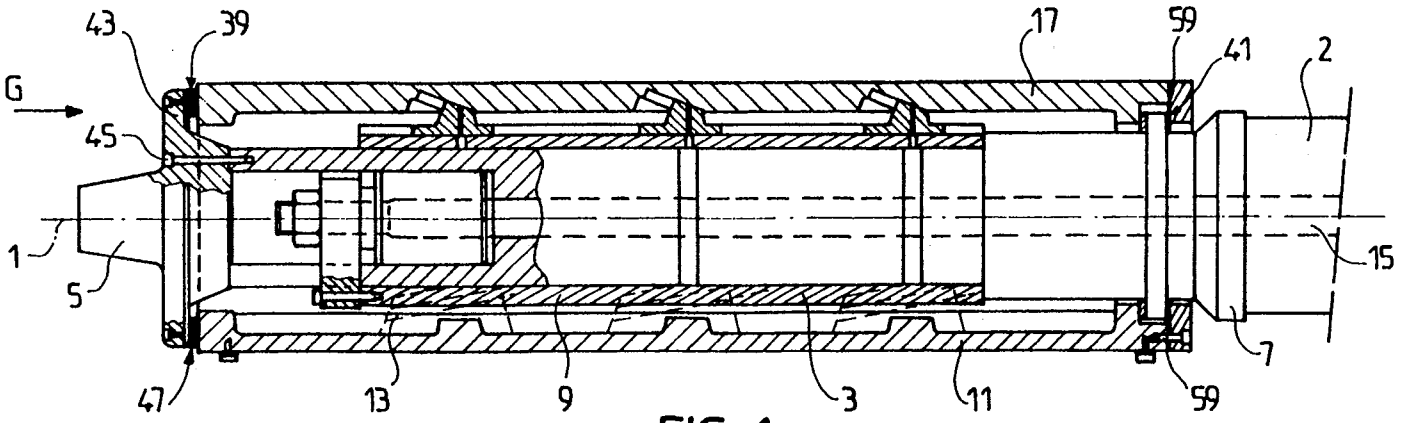
FIG. 1 is a longitudinal section view of the chuck according to the invention.
Figure 2:
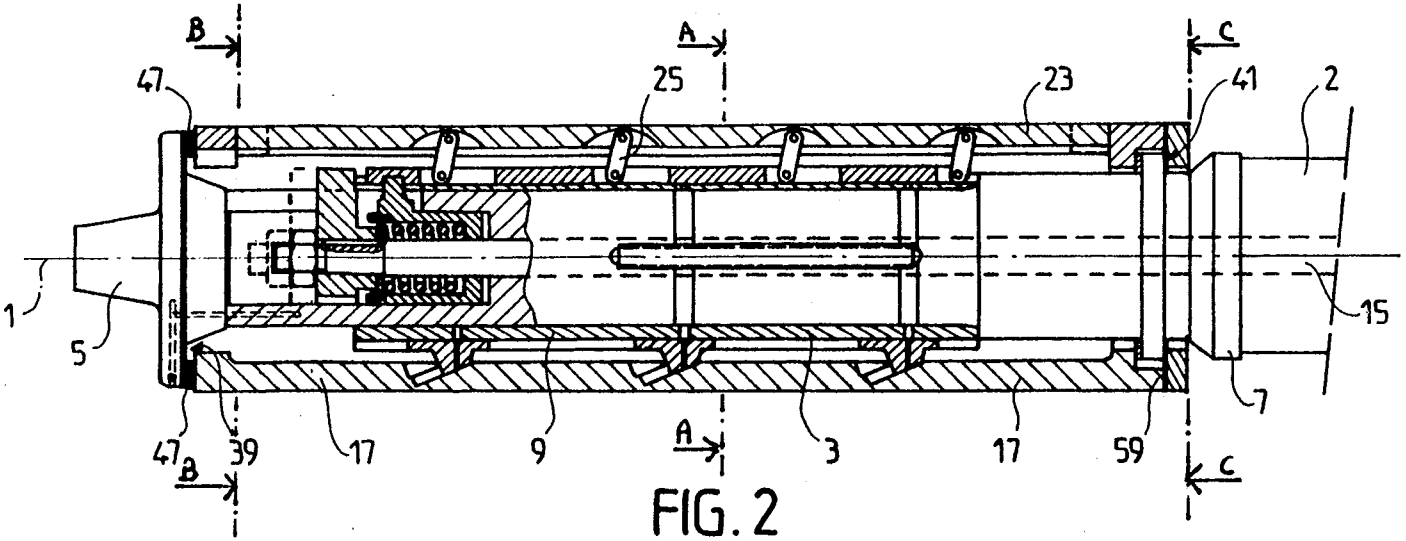
FIG. 2 is a second longitudinal section of the chuck according to the invention, showing the pinching bar.

The expandable cylindrical chuck of the invention is arranged for rotation around its longitudinal axis 1, under the action of the driving shaft 2. The body of the chuck 3 comprises a nose 5 and a rear section 7, as well as a tubular sheath 9.

The crosswise position of the segments 11 defining the modulus, i.e. the expanded or restricted position of the chuck, is determined by rack-mounted means 13 whose longitudinal displacement is produced and controlled by a driving shaft 15.

Longitudinal closing bars 17 extend over the entire length of the segments 11 and are in contact with them, whatever their crosswise position, i.e., whether the chuck is in a restricted or expanded position.

To this end, the segments, whose external surface 11*a* is approximately circular, comprise planar edges 11*b*, tilted with respect to the radius 19 of the chuck.

Closing bars 17 located between two segments 11 comprise tilted surfaces 17*b* and 17*c*, respectively complementary to the surfaces 11*b* and 11*c* of these segments.

During crosswise displacement of the segments 11, the closing bars 17 undergo a same displacement and their surfaces 17*b* and 17*c* remain in contact with the surfaces 11*b* and 11*c*.

According to another embodiment (not shown), the closing bars may be replaced with elastic bars.

Figure 3:
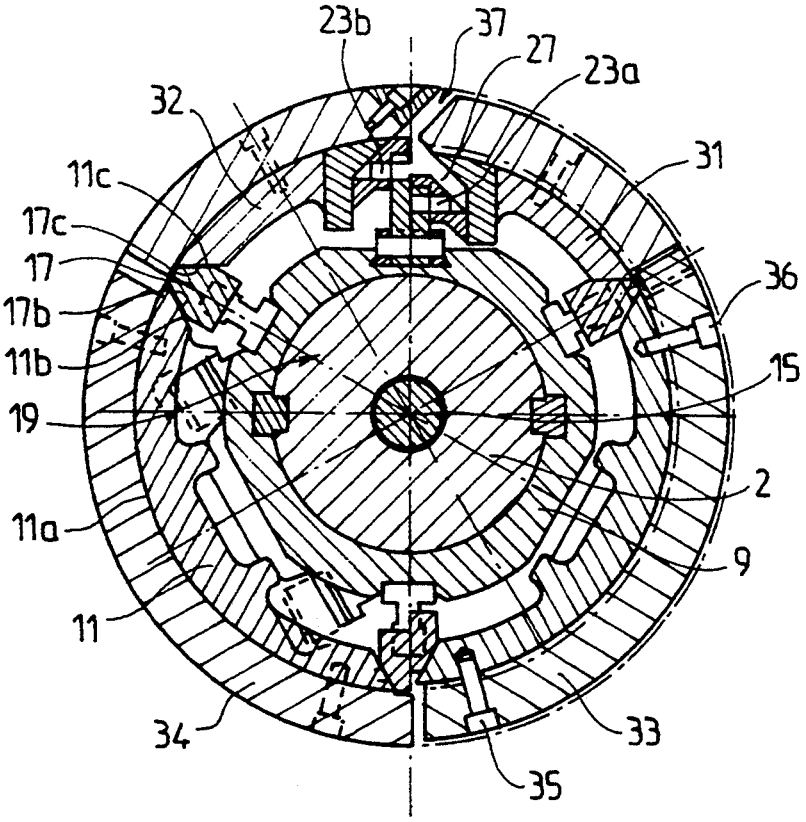
FIG. 3 is a cross-section view taken on line A—A of FIG. 2.

In FIG. 3, the chuck is shown in expanded position in the left-hand half and in a restricted position in the right-hand half.

Thus, the closing bars 17 allow the space between two successive segments 11 to be closed, whether the chuck is in restricted or expanded position.

Figure 4:
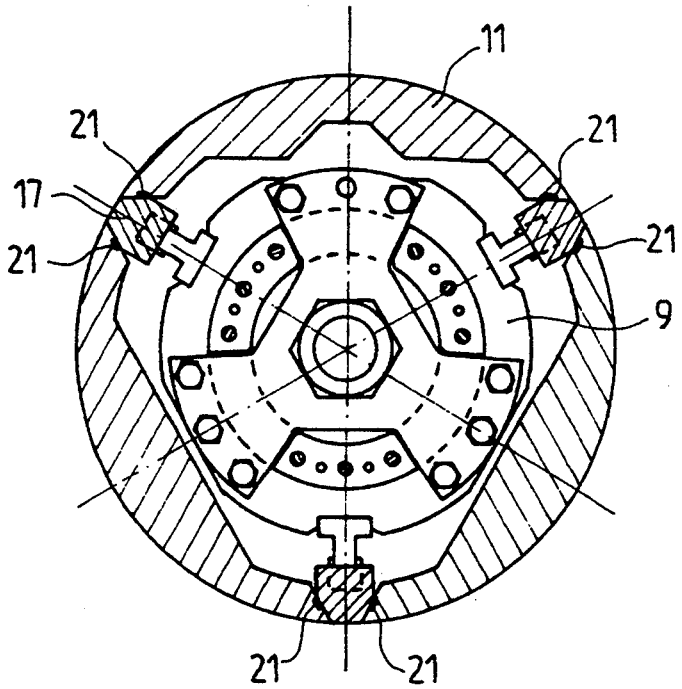
FIG. 4 is a cross-section view taken on line B—B of FIG. 2.

According to a preferred embodiment, seals 21, illustrated in FIG. 4 but not in the other figures, ensure tight contact between the closing bars 17 and the segments 11.

The expandable cylindrical chuck comprises a pinching bar 23 extending over the entire length of the chuck and allowing crosswise movement, produced and controlled by the driving shaft 15. Said pinching bar 23 is shown in inactive position 23*a* in the right-hand half of FIG. 3 and in active pinching position 23*b* in the left-hand half of the same figure. It is linked to the tubular sheath 9 by rods 25.

In inactive position, the pinching bar allows the insertion of the end of the strip or the strap into the groove 27. In active position, it squeezes the strip against the segment 11 with which it works and thus enables the coiling to start.

Seals 29 and 30, which may be lip seals, are provided between the pinching bar 23 and the segments 31, 32 located on both sides of the bar.

The segments 11 can be fitted with collars 33, 34, illustrated exclusively in FIG. 3, to increase the chuck diameter. These collars 33, 34 are mounted with screws 35, 36 on every segment 11. Obviously, they comprise a groove 37 clearing access to the groove 27 when the pinching bar 23 is in inactive position.

Tightness of the expandable cylindrical chuck is ensured at its ends 1 and along the closing and pinching bars. The nose 5 and the rear section 7 of the body of the chuck 3 each comprise an annular surface, respectively designated by 39, 41, which ensures tight contact between the chuck body 3, the segments 11 and the closing bars 17. It also comprises tight longitudinal surfaces for the closing bars 17.

The annular surface 39 of the nose 5 is formed on a flange 43 attached on the body of the chuck 3 by fixtures, screws or bolts 45. A seal 47 is advantageously provided between the annular surface 39 formed on the flange 43 and the segments 11, the closing bars 17 and the pinching bar 23. Seal 47 is attached to the flange 43 by fasteners, screws or bolts 49.

Tightness of the rear section 7 of the chuck is ensured by the annular surface 41 carried by the driving shaft 2 or a by a crown linked to the shaft, working with the fixtures 50, 51 and 52 carried on the ends of the segments 11 and with the fixtures 53 to 55 carried by the closing bars 17.

Figure 3A:
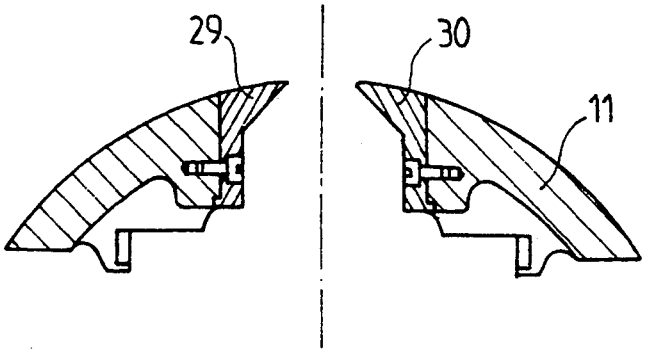
FIG. 3A is a detailed cross-section view of a segment.

Tightness of the pinching bar 23 is ensured by sealing means 29 and 30 carried by the segment 11, as shown in FIG. 3A.

Figure 3B:
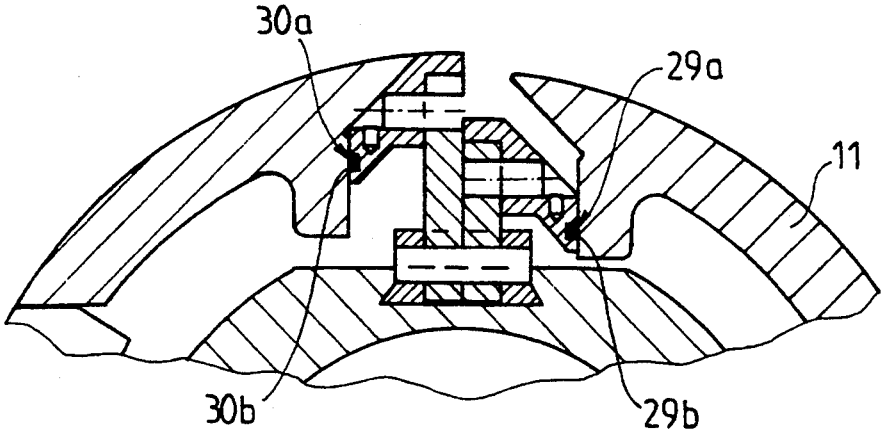
FIG. 3B is a detailed cross section view, centred around the pinching bar.
Figure 5:
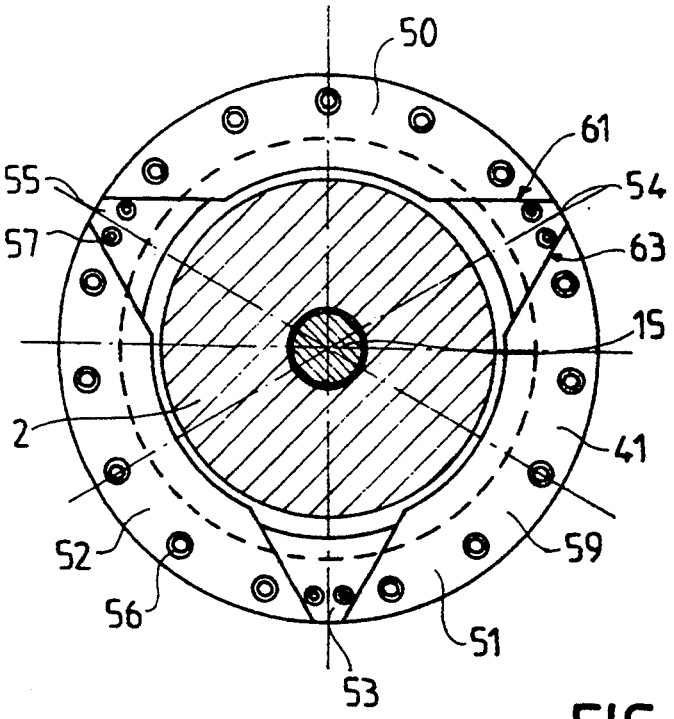
FIG. 5 is a cross-section view taken on line C—C of FIG. 2.
Figure 6:
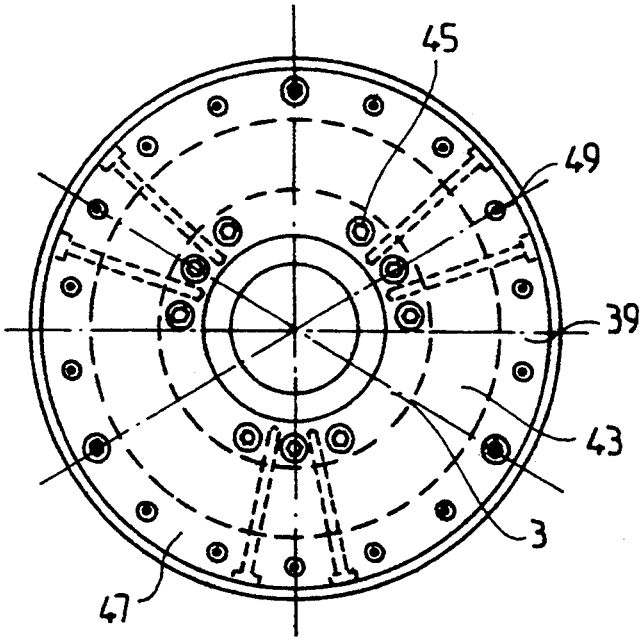
FIG. 6 is a section view in the direction of arrow G in FIG. 1.

According to another embodiment, as regards the guiding of the pinching bar in contact with the surfaces 29*a* and 30*a* of the segment 11, seals 29*b* are 30*b* are provided between the surfaces of the segment and the pinching bar, as shown in FIG. 3B.

The fixtures 50 to 52 are attached to the segments using the fasteners, screws or bolts 56.

In the same way, the fixtures 53 to 55 are attached to the closing bars 17 by the fasteners, screws or bolts, 57.

A seal 59 is advantageously provided between the annular surface 41 and the fixtures 50 to 55.

The relative movements of the segment fixtures 50–52 and closing bars 53–55, can be made easier at the same time as tightness is improved, by providing seals 61 and 63 located between each closing bar fixture, such as 54 and the segments 50 and 51 with which it is engaged. The respective forms of the segments fixtures 50 to 52 and of the closing bars fixtures 53 to 55 are complementary to the shapes described above, regarding the segments 11 properly speaking and the closing bars 17, so that the relative movements of these elements unfurl without any loss of tightness.

Thus, tightness of the expandable cylindrical chuck is ensured both on its cylindrical surface, more particularly between the segments and on its front ends (nose and rear section).

All risks of contaminations, especially small particles of iron, inside the chuck are eliminated, which reduces wear and enables lengthening the durability of the chuck.

This type of tightness is provided without interfering with the expansion and the retraction of the chuck nor without making its control more complex.

The invention can be implemented with different types of seals, for instance stripping seals or flat seals. The former can be sandwich seals with, for instance, an elastic layer between a bronze layer and a steel layer.

I claim:

1. Expandable cylindrical chuck for a coiler or uncoiler, said chuck having at least one restricted position and one expanded position, said chuck having a longitudinal axis and comprising:

(a) a chuck body with a nose and a rear section and a tubular sheath;

(b) a plurality of segments;

(c) rack-mounted means for longitudinal displacement to move said segments crosswise relative to said longitudinal axis;

(d) a control shaft controlling longitudinal displacement of said segments;

(e) closing bars located parallel to said longitudinal axis, between and in contact with said segments;

(f) a driving shaft operatively connected to said chuck body for rotating said chuck body around said longitudinal axis;

(g) a pinching bar connected to said chuck and adapted to perform a crosswise movement under control of said driving shaft;

(h) said nose and said rear section of said chuck body each comprising an annular surface ensuring tight contact between said chuck body and said segments, and between said closing bars and said pinching bar; and seals located between said annular surfaces of said chuck body and said segments, said closing bars and said pinching bar.

2. Expandable cylindrical chuck according to claim 1, wherein said seals are lip seals.

3. Expandable cylindrical chuck according to claim 1, wherein at least one of said annular surfaces is carried by an element attached to said sheath.

4. Expandable cylindrical chuck according to claim 1, wherein at least one of said annular surfaces is carried by said driving shaft.

5. Expandable cylindrical chuck according to claim 1, wherein said segments, said closing bars and said pinching bar each comprise, on at least one end thereof, a fixture designed for contact with one of said annular surfaces.

6. Expandable cylindrical chuck according to claim 5, wherein local seals are provided between said fixtures.

7. Expandable cylindrical chuck according to claim 1, wherein said closing bars carry seals ensuring their contact with the segments.

8. Expandable cylindrical chuck according to claim 1, wherein seals are provided between said pinching bar and the segments located on both sides of said bar.

9. Expandable cylindrical chuck for coiler or uncoiler, said chuck having at least one restricted position and one expanded position, said chuck having a longitudinal axis and comprising:

(a) a chuck body with a nose and a rear section and a tubular sheath;

(b) a plurality of segments;

(c) rack-mounted means for longitudinal displacement to move said segments crosswise relative to said longitudinal axis;

(d) a control shaft controlling longitudinal displacement of said segments;

(e) closing bars located parallel to said longitudinal axis, between and in contact with said segments;

(f) a driving shaft operatively connected to said chuck body for rotating said chuck body around said longitudinal axis;

(g) a pinching bar connected to said chuck and adapted to perform a crosswise movement under control of said driving shaft;

(h) said nose and said rear section of said chuck body each comprising an annular surface ensuring tight contact between said chuck body and said segments and between said closing bars and said pinching bar;

(i) lip seals being located between said annular surfaces of said chuck body and said segments, said closing bars and said pinching bar;

(j) at least one of said annular surfaces being carried by an element attached to said tubular sheath, and at least one of said annular surfaces being carried by said driving shaft;

(k) said segments, said closing bars and said pinching bar each comprising, at at least one of their ends, a fixture designed for contact with one of said annular surfaces;

(l) seals carried by said closing bars ensuring contact of said closing bars with said segments;

(m) seals provided between said pinching bar and said segments and being located on both sides of said pinching bar; and (n) local seals provided between said fixtures.

* * * * *